United States Patent [19]

Odani et al.

[11] Patent Number: 4,702,885

[45] Date of Patent: Oct. 27, 1987

[54] ALUMINUM ALLOY AND METHOD FOR PRODUCING THE SAME

[75] Inventors: Yusuke Odani; Kiyoaki Akechi; Nobuhito Kuroishi, all of Itami, Japan

[73] Assignee: Sumitomo Electric Industries, LTD., Osaka, Japan

[21] Appl. No.: 879,704

[22] Filed: Jun. 27, 1986

Related U.S. Application Data

[63] Continuation-in-part of Ser. No. 677,472, Dec. 3, 1984.

[30] Foreign Application Priority Data

| | | | |
|---|---|---|---|
| Dec. 2, 1983 | [JP] | Japan | 58-228968 |
| Dec. 9, 1983 | [JP] | Japan | 58-233245 |
| Jan. 7, 1984 | [JP] | Japan | 59-1090 |
| Mar. 23, 1984 | [JP] | Japan | 59-56492 |

[51] Int. Cl.[4] ..... B22F 3/24

[52] U.S. Cl. ..... 419/23; 75/249; 419/25; 419/28; 419/38; 419/44; 419/52; 419/67

[58] Field of Search ..... 419/23, 28, 25, 38, 419/44, 52, 67; 75/249; 420/537

[56] References Cited

U.S. PATENT DOCUMENTS

| | | | |
|---|---|---|---|
| 2,357,449 | 9/1944 | Bonsack | 75/142 |
| 3,297,435 | 1/1967 | Hanafee | 75/142 |
| 3,306,738 | 2/1967 | Young et al. | 75/143 |
| 3,325,279 | 6/1967 | Lawrence et al. | 420/547 |
| 4,274,873 | 6/1987 | Nadkarni | 419/32 |
| 4,347,076 | 8/1982 | Ray et al. | 419/23 |
| 4,435,213 | 3/1984 | Hildeman et al. | 148/11.5 P |
| 4,460,541 | 7/1984 | Singleton et al. | 419/42 |
| 4,575,450 | 3/1986 | Meunier | 419/41 |
| 4,615,735 | 10/1986 | Ping | 419/44 |

FOREIGN PATENT DOCUMENTS

| | | |
|---|---|---|
| 0100470 | 7/1983 | EPX European Pat. Off. |
| 0112787 | 12/1983 | EPX European Pat. Off. |
| 2537656 | 12/1982 | France. |

OTHER PUBLICATIONS

Kent R. Van Horn, Aluminum, Vol. I, Properties, Phys. Metallurgy and Phase Diagrams, American Soc. For Metals, Metals Park, Ohio (Table 1).

*Primary Examiner*—Stephen J. Lechert, Jr.
*Attorney, Agent, or Firm*—Cushman, Darby & Cushman

[57] ABSTRACT

A process for producing an aluminum alloy comprises: producing an aluminum alloy powder, consisting of (A) 10 to 36 wt % of Si, 1 to 12 wt % of Fe, 2 to 10 wt % of at least one of metal selected from the group consisting of Ni, Co, Cr and Mn, reminder of the alloy powder consisting of aluminum, or consisting of (B) 10 to 36 wt % of Si, 2 to 10 wt % of Ni, 2 to 10 wt % of at least one of metal selected from the group consisting of Fe, Co, Cr, and Mn, and remainder of the alloy powder consisting of aluminum; compressing a mass of the powder by either compacting the power or accumulating the powder in a can where in case of compacting the powders are so as to have its actual density ratio of 65% to 90%, and in case of the accumulation the powders are compressed so as to have its actual density ratio of not more than 90%; heating the thus compressed mass of powder in convection type heating furnace at a temperature of 250° C. to 550° C. for 5 to 20 hours; and hot extrusion-working the mass of powders at extrusion ratio not less than 4:1, without cooling said heated compressed mass of powders.

27 Claims, 6 Drawing Figures

ALUMINUM ALLOY AND METHOD FOR PRODUCING THE SAME

RELATED APPLICATIONS

This is a continuation in part application of U.S. Application Ser. No. 677,472 filed on Dec. 3, 1984, the complete disclosure of which is incorporated herein by reference.

FIELD OF THE INVENTION

The present invention relates to a method for producing an aluminum alloy. The present invention further relates to an improvement in the characteristics, particularly modulus of elasticity of an aluminum alloy, and a methods for producing such an aluminum alloy having such advantageous characteristics.

More particularly, the present invention provides a light weight aluminum alloy having high strength, high heat resistance, high wear resistance and low expansion coefficient, and a process for the producing such an alloy having such advantageous characteristics.

BACKGROUND OF THE INVENTION

Aluminum alloys are light weight and have about one third the specific gravity of steel materials, and are also superior in corrosion resistance. Furthermore, since plastic working of aluminum alloys can be carried out easily at low temperatures, they are metallic materials suitable for a reduction in weight of equipment and energysaving. However, aluminum itself is inherently low in strength and inferior in heat resistance and wear resistance. It is therefore unsuitable for use in fabrication of mechanical parts for which are required a high strength, and heat resistance and wear resistance.

Recently, various alloying methods and heat treatments, for example, have been developed. As a result, high performance aluminum materials have been developed and their application in various fields is now under investigation. For example, in 1911, A. Wilm developed high strength aluminum alloys such as Duraluminum, and these aluminum alloys have been widely used in production of air crafts. Duraluminum has a composition of 4% Cu, 0.5% Mg, 0.5% Mn, 0.3% Si, with the balance being Al, and has a tensile strength of about 40 kg/mm$^2$ (see Hashiguchi ed., *Kinzoku Gaku Handbook* (*Handbook of Metalography*), 1958. In addition, as heat resistant and wear resistant materials, aluminum/silicon-base alloys have been developed. They are called "Silmin" TM, in which wear resistance is increased by adding from 10 to 20% by weight of Si particles to the Al matrix. In this case, however, the primary silicon crystals are readily increased in size as the result of addition of a large amount of Si, and the strength is inevitably decreased.

As heat resistant, wear resistant materials, Al—Fe-base and Al—Si-base alloys, for example, are known. At present, an extensive investigation is being made on their application as engine parts of a vehicle, such as piston and cylinder liner. For these heat resistant, wear resistant alloys, it is also required that the coefficient of thermal expansion is low. An aluminum alloy usually has a co-efficient of thermal expansion of more than $22\times10^{-6}/°$ C. In production of a piston, for example, it is desirable that the aluminum alloy have a coefficient of thermal expansion of not more than $21\times10^{-6}/°$ C. For many of the conventional Al—Fe-base and Al—Si-base alloys, the coefficient of thermal expansion is more than $21\times10^{6}/°$ C. Thus they are not suitable for use in the production of a piston, for example.

As alloys produced by powder metallurgy, aluminum sintered bodies in which finely divided aluminum oxide is dispersed in aluminum have been developed under the name of "SAP". They were developed to increase heat resistance, and their strength is 35 kg/mm$^2$ and thus they are brittle, i.e., they have a disadvantage in that the impact resistance is low. For this reason, they have not yet been put into practical use.

Production of mechanical parts of aluminum alloys by the powder metallurgical method has now been put into practical use. In addition to a method comprising the usual powder compacting the sintering and sizing, a cold forging method in which after sintering, coining is applied is also included. Aluminum alloy metal parts produced by the above powder metallurgical method, however, are inferior in mechanical properties such as tensile strength, wear resistance, and heat resistant strength to those produced by cutting, forging, and casting of melted materials.

Next, an explanation is made as to an improvement of modulus of elasticity in high strength aluminum alloy.

As high strength aluminum alloy materials, a 7000 aluminum alloy and a 2000 aluminum alloy are well known. In recent years, a 7090 aluminum alloy and a 7091 aluminum alloy having a much higher strength have been developed in U.S.A.

Such high strength aluminum alloys are used mainly in the production of aircraft. For these aluminum alloys for aircraft are required to have high elasticity and high strength. It is desirable that the modulus of elasticity and strength be at least 8,500 kg/mm$^2$ and at least 60 kg/mm$^2$, respectively. Aluminum alloys now on the market have a tensile strength of about 60 kg/mm$^2$, but their modulus of elasticity is less than 8,000 kg/mm$^2$, which is less than $\frac{1}{2}$ of that of the iron-base material. Furthermore, it is said that these aluminum alloys are sacrificed in corrosion resistance. In order to produce an aluminum alloy having a high modulus of elasticity, attempts to combine with carbon or ceramic fibers, or particles, or to add lithium, for example, have been made. No satisfactory aluminum alloy has been developed.

For many of mechanical parts which need high wear resistance, high strength and high heat resistance are required at the same time. Thus the above-described conventional aluminum alloys are not suitable for use in the production of such mechanical parts.

The casting method is not acceptable for producing high Si content aluminum alloy. If high Si contained aluminum alloy comprising not less than 10% of Si, not less than 2% of transition element such as Fe and Ni, and Cu and Mg and balance aluminum is produced by the casting method, the size of precipitation elements of Si and Fe is increased upon solidification, so that the desired characteristics, such as high wear resistance, of the resultant alloy deteriorate, and cracks may occur upon casting. The increased size of precipitated crystals may be regulated. The increase of precipitation size may be regulated to some extent by adding phosphorus. However, reduction of precipitation size by phosphorus addition does not permit production of an aluminum alloy having high mechanical properties, such as mechanical strength.

SUMMARY OF THE INVENTION

The present invention is intended to overcome the above problems.

The present invention provides a phosphorus-free method for producing an aluminum alloy which comprises producing an aluminum powder consisting of (A) 10 to 36 wt% of Si, 2 to 12 wt% of Fe, 2 to 10 wt% of at least one of metal selected from the group consisting of Ni, Co, Cr and Mn, reminder of the alloy powder consisting of aluminum, or (B) 10 to 36 wt% of Si, 2 to 10 wt% of Ni, 2 to 10 wt% of at least one of metal selected from the group consisting of Fe, Co, Cr and Mn, and remainder of the alloy powder consisting of aluminum; compressing a mass of the powder by one of compacting the powder, and accumulating the powder in a can, where in the case of compacting the powder being compacted so as to have its actual density ratio of 65% to 90%, and in case of the accumulation the powder is compressed so as to have its actual density ratio of not more than 90%; heating the thus compressed mass of powder in convection type heating furnace (i.e. non-induction type furnace) at a temperature of 250° C. to 550° C. for about 5 to about 20 hours; and hot extrusion-working the mass of powder at an extrusion ratio not less than 4:1 without cooling said heated compressed mass of powders. Advantageously, the extrusion ratio is greater than 10:1.

The present phosphorus-free method produces an aluminum alloy having fine silicon crystal size by controlling the cooling rate while preparing the powders i.e. during atomization.

The present invention provides a high heat resistant, wear resistant aluminum alloy that is provided with high strength, high wear resistance, and high heat resistance as well as an improved coefficient of expansion, which are required for mechanical parts, by adding alloying elements superior in improving wear resistance and alloying elements superior in improving heat resistance in a suitable ratio to aluminum alloys.

The present invention provides a process for the producting an aluminum alloy in which the wear resistance and heat resistance and also the thermal expansion of the aluminum alloy are greatly improved by adding a silicon element for improving wear resistance and at least one metal element selected from the group consisting of Fe, Ni, Co, Cr and Mn for improving heat resistance and mechanical strength at room temperature in a suitable ratio to aluminum.

The present invention is further intended to improve the characteristics of an aluminum alloy, and it has been found in the course of improving the strength, wear resistance, and heat resistance by adding a silicon element, an iron element, a copper element, and a magnesium element to the aluminum that an aluminum alloy containing a silicon element in a concentration in the vicinity of the eutectic point has a high modulus of elasticity.

According to another embodiment of the invention, aluminum alloy comprises 7.0 to 17.0 wt% of Si, not more than 12 wt% of Fe, not more than 2 wt% of Mg, not more than 6.5 wt% of Cu, and remainder Al. The aluminum alloy has a modulus of elasticity not less than 8000 kg/mm$^2$ and has a crystal size in the alloy of not greater than 10μ.

DESCRIPTION OF THE PREFERRED EMBODIMENTS

Figure 1:
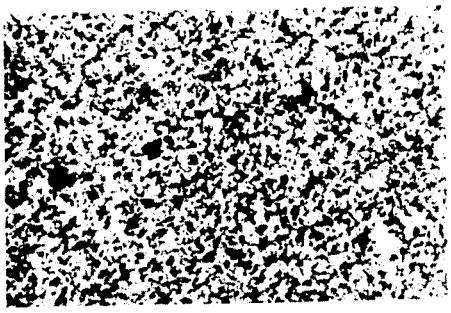
FIG. 1 is a micrograph (1000) of an aluminum alloy produced in Example of the present invention.

According to one embodiment of the invention, a process for producing an aluminum alloy comprises producing an aluminum alloy powder consisting of (A) 10 to 36 wt% of Si, 2 to 12 wt% of Fe, 2 to 10 wt% of at least one of metal selected from the group consisting of Ni, Co, Cr and Mn, reminder of the alloy powder consisting of aluminum or consisting of (B) 10 to 36 wt% of Si, 2 to 10 wt% of Ni, 2 to 10 wt% of at least one of metal selected from the group consisting of Fe, Co, Cr and Mn, and remainder of the alloy powder consisting of aluminum; compressing a mass of the powder by one of, compacting the power, and accumulating the powder in a can, where in case of compacting the powders, the compacted powder has an actual density ratio of 65% to 90%, and in the case of the accumulation of powder, the powder is compressed so as to have its actual density ratio of not more than 90%; heating the thus compressed mass of powder in convection type heating furnace (i.e. non-induction) at a temperature of 250° C. to 550° C. for 5 to 20 hours; and hot extrusion-working the mass of powders at an extrusion ratio not less than 4:1, and preferably not less than 10:1 without cooling said heated compressed mass of powders, whereby an aluminum alloy having a crystal size in the alloy not greater than 10 μm is obtained.

The process of the present invention includes additional features in further embodiments.

Advantageously, not more than 6.5 wt% of Cu and not more than 2 wt% of Mg are added in the aluminum alloy powder producing step. The aluminum alloy powder produced in accord with the invention provides an intermetallic alloy having precipitated particles in which the size of the intermetallic crystal grains are not more than 10μm. In the process, raw materials for the aluminum alloy can be melted and directly atomized from a hot crucible, and simultaneously cooled at cooling speed not less than 10$^2$K/sec in the powder production step. If the cooling speed (rate) is less than 10$^2$ K/sec., then the size of silicon precipitate is increased thereby degrading the properties of the compacted and extruded powder. The thus atomized aluminum alloy powder has, advantageously, a mesh size of −40 mesh. In the process, the aluminum alloy powder can be filled in a metal die in the compacting step. Advantageously, cold-isostatic pressure can be applied to the aluminum alloy powder in the powder compression step. In the present process, the mass of the powders can be heated in air by an electric heater or can be heated in a non-oxidative condition by an electric heater.

The process can produce an aluminum alloy consisting of 20 wt% of Si, 8 wt% of Ni, Cu, Mg, and remainder Al, or an aluminum alloy consisting of 20 wt% of Si, 5 wt% of Fe, 2 wt% of Ni, and remainder Al; or an aluminum alloy consisting of 12 wt% of Si, 5 wt% of Fe, C, Mg and remainder Al.

The process produces an aluminum alloy having modulus of elasticity of at least than 8000kg/cm$^2$.

In the present invention, the powder compact has an actual density of 65% to 90%. In case of the density of powder in the can, the density is not more than 90%. If the density is less than 65%, the compact may be broken. In case of the powder compact, if its density exceeds 90%, voids or pores remain in the powder compact, so that sufficient degassing cannot be performed. As a result, the gas confined with the final compact may be expanded at high temperature upon heat treatment thereof, to thereby degrade characteristics of the resultant alloy product.

Degassing is thus required in the present process. In general the powders have large surface areas in their entirety, the powders contain large amounts of gas absorbed therein and particularly contain moisture. For handling the powders to preform degassing, powders be compacted together or accumulated in a can. According to one embodiment of the present invention, the powder compact is degassed subjecting the compact to heating in an electric heater at a temperature ranging from 250° C. to 550° C. from about 2 to 20 hours. If the temperature and heating period is less than 2 hours, the above lower limit, sufficient degassing may not be performed. On the other hand, if the heating period is longer than the upper limit, then it is costly, and the Si crystal size is promoted thereby resulting in degraded alloy product characteristics. The above mentioned degassing process is one of the essential features in the method of the present invention.

Advantageously, the powder degassing is performed during the heating step in the present process.

In the present process, the pressure of not less than 6000kg/cm$^2$ is required in order to obtain powder density of at least 90% in case the powders in accordance with the present invention are employed (i.e., the composition in accordance with the above-mentioned percentile, and mesh size of −40mesh). The pressure is advantageously applied by cold isostatic molding.

With respect to plastic working, an extrusion step is employed in which extrusion ratio is defined in the present invention to obtain an extrudate having sufficient mechanical strength.

In the aluminum alloy produced in accordance with the present invention, a silicon element is added to increase the wear resistance. The amount of the silicon element added is from 10 to 36% by weight and advantageously is added in an amount ranging from 10 to 20% by weight. If the amount of the silicon element added is less than 10% by weight, than the wear resistance is improved only insufficiently. As the amount of the silicon element added is increased, the wear resistance is more increased. Addition of an excess amount of the silicon element, however, leads to a reduction in the strength of the ultimate aluminum alloy. Thus the silicon element is added in an amount not more than 36% by weight to avoid reduction in the strength of the ultimate aluminum alloy. In the usual wear resistant Al—Si-base alloy, it is possible for the silicon element to be incorporated in an amount up to about 50% by weight by the powder metallurgical method, and the silicon content is changed depending on the purpose for which the ultimate aluminum alloy is used. As a result of extensive investigations, it has been found that if the silicon and at least one metal element selected from Fe, Ni, Co, Cr and Mn are added in a suitable ratio, there can be obtained an aluminum alloy exhibiting wear resistance higher than that of a high silicon-content wear resistant Al—Si-base alloy and, furthermore, having a greatly low coefficient of thermal expansion without the addition of a large amount of the silicon element. This aluminum alloy exhibits higher heat resistance even when at least one metal element is added in an amount less than that in the usual Al—Fe-base heat resistant alloy. The amount of the metal element added is appropriately between 2 and 10% by weight. Outside this range, the heat resistance, wear resistance, and coefficient of thermal expansion are improved only insufficiently. If the amount of the iron element added is too large, the ultimate aluminum alloy has a disadvantage in that workability such as hot extrusion is poor.

If at least one metal and silicon elements are added in a suitable ratio, strength, the heat resistance, wear resistance, and coefficient of thermal expansion are improved greatly at the same time. In view of this marked reduction in coefficient of thermal expansion, the aluminum alloy of the present invention can be expected to find many uses.

The aluminum alloy powder that is used in the present invention is basically an Al—Si—Fe-base alloy and, for the purpose of further increasing the strength of the alloy, copper and magnesium elements are added thereto. The copper element is added to increase the strength to enhance precipitation in the matrix. Even if the copper element is added in amounts more than 12% by weight, no marked increase in strength can be obtained, and moreover the density is increased. Thus it is not necessary to add the copper element in amount more than 12% by weight. However, since the copper contributes to heat resistance, it is preferred to add in a certain amount in a range of 1.0 to 12 wt%. Addition of the magnesium element also contributes to an increase in the strength. However, if the magnesium element is added in large amounts, workability is reduced. Thus the amount of the magnesium element is in a range of 0.1 to 3.0 wt%.

The aluminum alloy of the present invention is difficult to produce by the conventional casting method, because the amounts of silicon and at least one metal element such as Fe are large. The reason for this is that the primary crystals of silicon and iron are coarsened at the time of solidification. These strong coarse primary crystalline particles seriously deteriorate the strength. In order to decrease the size of the coarse primary crystals, it is important that a rate of solidification of the alloy be increased, as disclosed hereinbefore, to not less than $10^2$ K/Sec. This is difficult to attain by the casting method. Thus, for this purpose, the powder metallurgical method is employed. That is, rapidly solidified aluminum alloy powder is first produced, and then the desired alloy is produced using the alloy powder in which the primary crystals are reduced in size.

In order to prevent the formation of coarse primary silicon crystals, when the alloy powder is used in the form of a gas atomized powder, it is preferred that its grain size be −40 mesh. In the case of the gas atomized powder, as long as the grain size is −40 mesh, the grain diameter of the primary crystals can be controlled to 10 μm or less. The grain diameter of the primary crystals is sometimes increased by a variation in production conditions. In this case, it is necessary to use a powder in which the grain diameter of the primary crystals, mainly silicon crystal size, is 10 μm or less.

According to one embodiment of the present invention, above-prepared aluminum alloy powders are packed directly in a can or compacted. This can or mold is then heated to 250°-550° C. and hot extruded at an extrusion ratio not less than 4:1, preferably not less than 10:1. In order to produce vanes for compressor, the ratio be not less than 20:1. If the temperature is less than 150° C., plugging occurs. On the other hand, if it is more than 550° C., the primary silicon crystals are coarsened during working, and an extruded material having good characteristics cannot be obtained. If the extrusion ration is less than 4:1, a material having a sufficiently high strength cannot be obtained. For example, 400° C. and at an extension ratio of at least 4:1, the impact strength of a powder (by μ [A(20 Si-5 Fe—Co—Mg] substantially and unexpectedly exceeded that of a casted product obtained by the prior art casting method. Thus, the extrusion is carried out within the above-defined ratio.

During extrusion, the ratio should not fall below 10:1. Extruding the compact at lower ratios means inadequate plastic deformation occurs whereby the mutual joining of powders becomes insufficient leading to a product having degraded, it, undesired, properties.

The thus-extruded material is subjected to a suitable heat treatment and then machined into the desired product.

Figure 4:
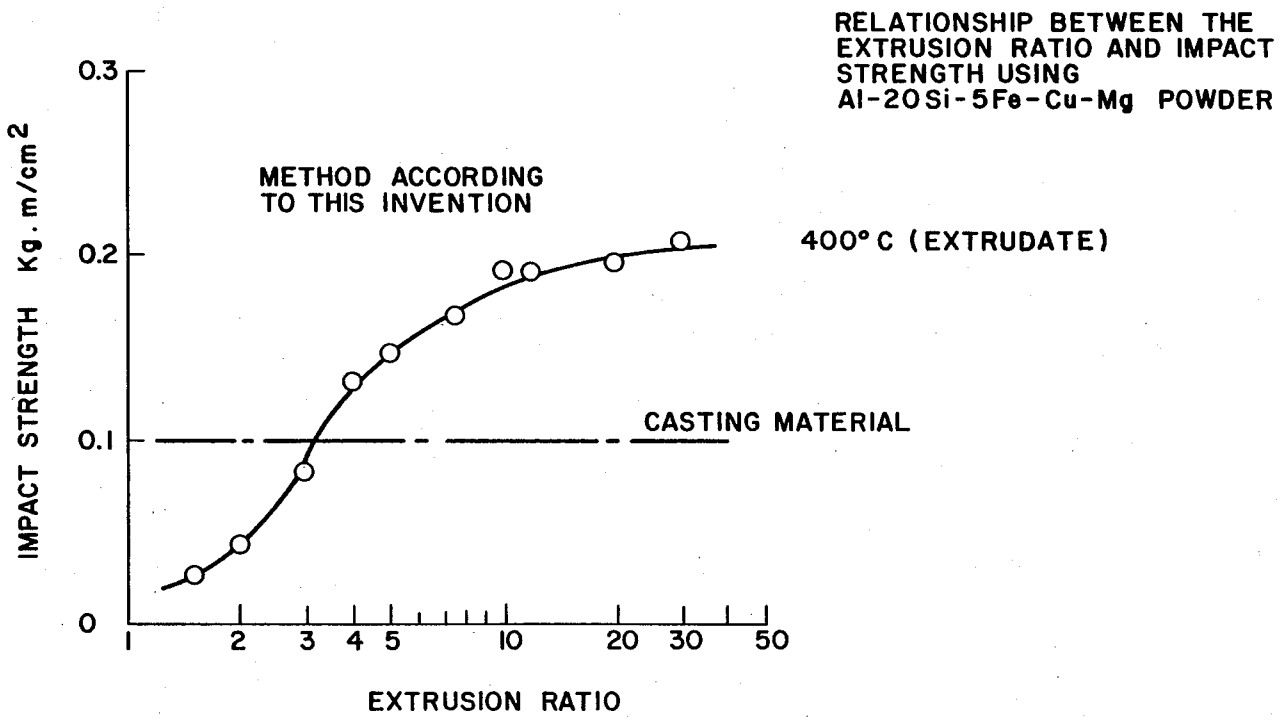
FIG. 4 is a graph of the relationship between the extrusion ratio and impact strength using Al—20Si—5-Fe—Cu—Mg powder.
Figure 5:
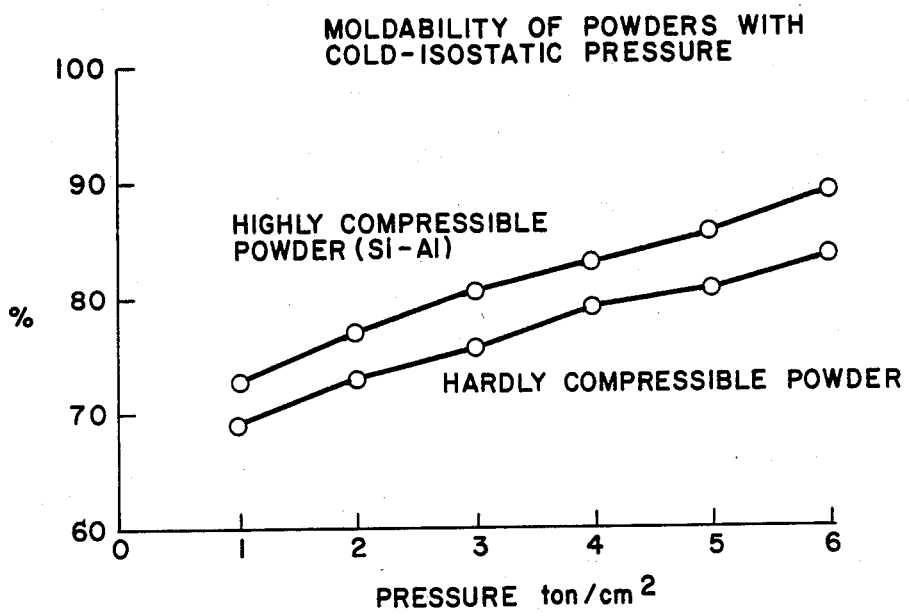
FIG. 5 is a graph of the Moldability of powders with cold-isostatic pressure.
Figure 6:
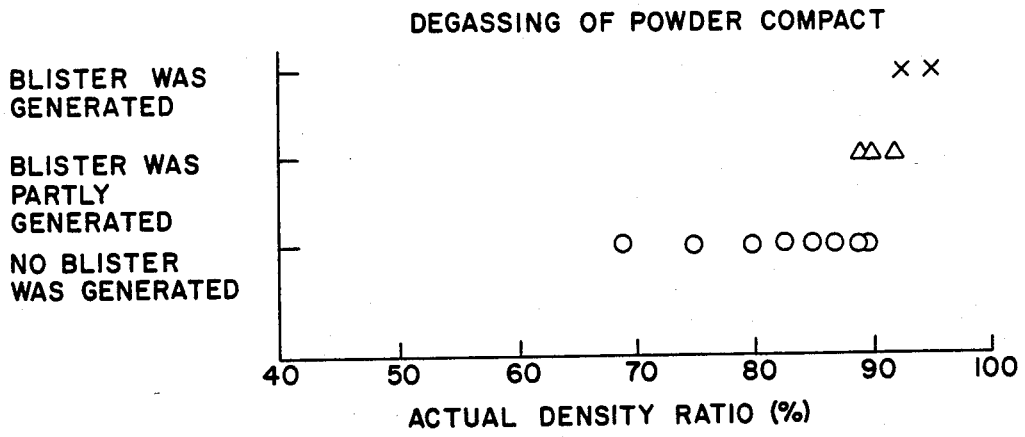
FIG. 6 is a graph of the degassing of powder compact.

Experiments have been performed which demonstrate the advantages of an aluminum alloy having components of Fe and Ni. Results and supporting data are presented in FIGS. 4,5 and 6, and Table 1. The experiments entailed the following procedures.

Test pieces of aluminum alloy were prepared in accordance with the method of the present invention. The testing pieces numbers 1-7 (see Table 1) belong to the present invention, and testing pieces numbers 10-12 are comparative examples which do not contain therein Fe or Ni.

Measurement of the Modulus of Elasticity was made by ultrasonic wave measurement, and wear test were made employing the Ogashi wear test. Testing piece nos. 1-4 were Al—Si—Fe type alloy, and testing piece nos. 5 and 6 were Al—Si—Ni type alloy. In the testing pieces Nos. 7-9, Mn, Cr or Co are added into an Al—Si composition.

TABLE 1

Properties of $^{P}$/M Al Alloys

| No. | | Tensile Strength Kg/mm² RT | Tensile Strength Kg/mm² 300° C. | Young's Modulus Kg/mm² | Hardness HRB | Impact Strength Kgm/cm² | Thermal Expansion ×10⁻⁶/°C. | Specific Wear Amount* × 10⁻⁷mm²/lg Sliding Speed m/s 0.5 | 2.0 | 3.6 |
|---|---|---|---|---|---|---|---|---|---|---|
| | Invention | | | | | | | | | |
| 1 | Al—20Si—5Fe | 38 | 19 | 9500 | 78 | 1.2 | 17.2 | 1.8 | 3.3 | 2.1 |
| 2 | Al—20Si—5Fe—3Cu—1Mg | 45 | 15 | 10200 | 95 | 0.15 | 17.0 | 1.6 | 2.9 | 1.5 |
| 3 | Al—20Si—8Fe—3Cu—1Mg | 48 | 18 | 10400 | 98 | 0.1 | 16.5 | 1.1 | 1.3 | 1.6 |
| 4 | Al—30Si—5Fe—3Cu—1Mg | 45 | 17 | 10300 | 104 | 0.1 | 15.1 | 0.8 | 1.1 | 1.2 |
| 5 | Al—20Si—8Ni—3Cu—1Mg | 46 | 16 | 10400 | 95 | 0.2 | 16.1 | 1.2 | 1.5 | 1.7 |
| 6 | Al—20Si—5Fe—2Ni | 41 | 25 | 10100 | 82 | 1.1 | 16.4 | 1.5 | 2.8 | 2.0 |
| 7 | Al—20Si—5Fe—2Mn | 39 | 20 | 9800 | 80 | 0.8 | 16.8 | 1.7 | 3.3 | 2.0 |
| 8 | Al—20Si—5Cr | 30 | 10 | 8200 | 56 | 1.3 | 17.3 | 4.4 | 11 | 7.3 |
| 9 | Al—20Si—5Co | 33 | 12 | 8300 | 61 | 1.1 | 17.2 | 4.2 | 11 | 7.4 |
| | Comparative | | | | | | | | | |
| 10 | Al—20Si | 31 | 9 | 7900 | 52 | 1.2 | 17.8 | 4.5 | 14 | 8.1 |
| 11 | Al—20Si—3Cu—1Mg | 42 | 8 | 8400 | 60 | 0.3 | 17.5 | 1.5 | 9.1 | 4.3 |
| 12 | Al—30Si—3Cu—1Mg | 40 | 9 | 9600 | 76 | 0.2 | 15.7 | 1.0 | 2.2 | 2.3 |

*Ogoshi Wear Test

Judging from thses data, the following can be demonstrated as shown in Table 1, and Gis 4, 5 and 6.

(1) When comparisons are made between No. 1 and No. 10, between No. 2 and No. 11, and between No. 4 and No. 12, it is clear that the alloys containing Fe exhibited excellent characteristics in comparison with an alloy which does not contain Fe. Therefore, Fe element in the alloy provides advantages.

(2) When a comparison is made between Nos. 5 and 11, characteristics of alloy which contain Ni is improved over that of the alloy which does not contain Ni, even though the improvement is not so remarkable in comparison with the improvement in the alloy containing Fe component.

(3) When a comparison is made between samples Nos. 1 and 6, addition of Ni to the Al—Si—Fe provided excellent effect in terms of tensile strength at elevated temperature and modulus of elasticity (Young's modulus).

(4) When a comparison is made between the sample Nos. 1 and 7, addition of Mn into Al—Si—Fe provided some advantage. However, the effect of addition of Mn is not so remarkable in comparison with the effect of addition of Fe or Ni.

(5) When comparisons are made between sample Nos. 8, 9 and 10, addition of Co or Cr my provide an advantage. However, this advantage is not so remarkable in comparison with the alloy containing Fe or Ni.

(6) When comparisons are made between the samples 1 and 2, and between samples 10 and 11, the addition of Cu and Mg provided an improvement.

According to these data, the followings become apparent:

(1) Fe is one of the requisite elements to obtain a desirable Al—Si alloy.

(2) Ni is also one of the requisite elements, even though its beneficial function does not appear to be greater than that of Fe.

(3) Ni, Cr, Co and Mo also provided superior results on the basis of the Al—Si—Ni group.

(4) Fe, Cr, Co and Mo also provide superior results on the basis of the Al—Si—Ni group.

(5) Cu and Mg would be the elements to be added to Al—Si—Fe or Al—Si—Ni group.

In the case of the Al—Si—Fe group, compounds are formed such as $Al_3Fe$, $Al_6Fe$, and Al—Si—Fe (unknown chemical structure). In case of the Al—Si—Ni group, $Al_3Ni$, $Al_6Ni$, Al—Ni—Fe (unknown chemical structure) are formed. In case of Al—Si—Fe—NI group, $Al_3$(NiFe), $Al_6$(NiFe), AlSi—Fe—Ni are formed in addition to the above compounds. These compounds serve as dispersion promotive particles to enhance mechanical strength, thermal resistance, Young's modulus, thermal expansion, wear resistance and hardness. In case of the Al—Si alloy, since no such compounds are formed, alloy characteristic are inferior to that of the present invention.

In the case of the alloy containing Co, Cr, or Mn, no clear chemical structure is known. However, these elements provide the resultant alloy characteristics lower in quality than that of the alloy containing Fe or Ni.

The complete disclosure of Japanese Patent Application No. 60-32457 and the complete disclosures of Japanese patent publications, 60-120544, 60-121203, 60-145349 and 60-200945 are incorporated herein by reference.

The present invention is further described with reference to the following non-limiting Examples.

EXAMPLE 1

An aluminum alloy powder containing 12% by weight of silicon and 8% by weight of iron, of −100 mesh which had been gas atomized was packed in a sheath made of copper or aluminum and sealed, which was then heated to 450° C. and hot extrusion at an extrusion ratio of 6.5:1.

The characteristics of the hot extruded material under the above conditions were evaluated, and the results are shown in Tables 2 and 3. As can be seen from its micrograph (1000) shown in FIG. 1, the structure of the aluminum alloy was fine and uniform.

1. Tensile Strength at High Temperature (determined after holding for 20 minutes at each Temperature)

TABLE 2

| Temperature (°C.) | Tensile Strength (kg/mm$^2$) |
|---|---|
| R.T. | 42 |
| 100 | 44 |
| 200 | 40 |
| 300 | 28 |
| 400 | 12 |

2. Ring Crash Strength at High Temperature

TABLE 3

| Temperature (°C.) | Ring Crash Strength at High Temperature (kg/mm$^2$) |
|---|---|
| R.T. | 65 |
| 100 | 86 |
| 200 | 85 |
| 300 | 63 |
| 400 | 32 |
| 500 | 16 |

3. Wear Test (by the Ogashi method)
Pressure: 3.3 kg
Wear Distance: 200 m
Sliding Speed (m/s): 0.5 2.0 3.6
Specific Wear Amount (mm$^2$/kg)$\times 10^{-7}$: 2.1 1.8 7.1

4. Coefficient of Thermal Expansion $17.5\times 10^{-6}$/° C. at 300° C.

The Al—Si—Fe-base alloy produced by the process of the present invention in which silicon and iron are added in a suitable ratio is superior in heat resistance and wear resistance and further has a very low coefficient of thermal expansion. Thus the alloy is excellent as a heat resistant material.

EXAMPLE 2

An alloy powder of 4% Cu, 1% Mg, 12% Si, 5% Fe, the balance being Al, having a grain size of −40 mesh which had been produced by atomizing method was placed in a sheath made of copper and then sealed, which was then heated to 450° C. and extruded at an extrusion ratio of 10:1. The thus-produced alloy was examined.

Figure 2:
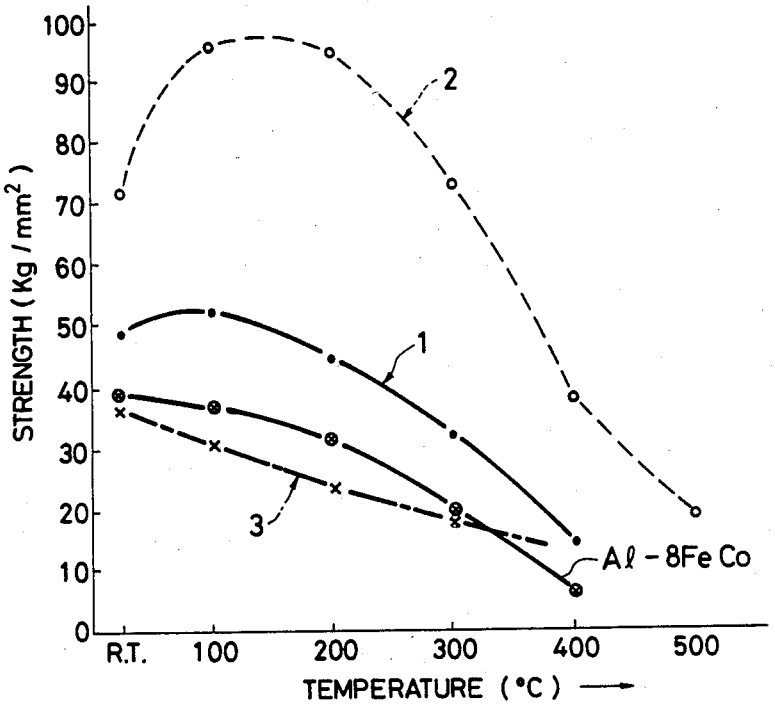
FIG. 2 is a graph showing the relation between temperature and the tensile strength (1) or ring crash resistance (2) of the alloy of the present invention, or the tensile strength of the conventional sintered Al alloy (3)

FIG. 2 shows the results of the measurement of strength of a test piece which had been cut off of the above alloy material. The tensile strength 1 and 2 of the alloy of the present invention are high at room temperature and also at high temperatures, and are superior compared with the tensile strength 3 of the conventional heat resistant Al-sintered body (SAP).

The wear resistance as determined by the Ogashi wear testing method is shown in Table 4.

TABLE 4

| | Specific Wear Amount (mm/kg) $\times 10^{-7}$ | | |
|---|---|---|---|
| Sliding Speed Test Piece (m/s) | 0.5 | 2.0 | 3.6 |
| Alloy of the Invention | 1.6 | 1.2 | 6.2 |
| Comparative Alloy 1 | 3.0 | 12.3 | 11.4 |
| Comparative Alloy 2 | 3.1 | 19.8 | 13.0 |

In Table 4 above, the comparative alloy 1 is an AC-8A-T6 cost Al—Si alloy processed material conventionally used in the production of pistons, and the comparative alloy 2 is a material 7090 produced by the powder metallurgical method.

A coefficient of thermal expansion of the alloy of the present invention is $16.1\times 10^{-6}$/° C. between ordinary temperature and 300° C., which is considerably small compared with $24.0\times 10^{-6}$/° C. of pure aluminum. Thus the alloy of the present invention can be advantageous as a heat resistant material. As mentioned above, an alloying elements can be added in a super saturated condition by the rapidly solidifying method ad, as a result of rapid-cooling, crystal grains are finely dispersed, segregation is avoided, a uniform structure can be obtained and, furthermore, a melted material from which the present powder metallurgical material is made can be obtained, which is much superior in performance to the conventional ingot metallurgical materials. These rapidly solidified alloys, however, can be produced only by the extrusion method, for example, and thus problems are encountered in producing mechanical parts. The reason for this is that an aluminum alloy usually has a stable oxide $Al_2O_3$ on the surface thereof and, therefore, it is very difficult to sinter the aluminum alloy in the solid state and mechanical parts cannot be almost produced using the aluminum alloy. A method has been proposed in which alloying elements such as copper, magnesium, and silicon, capable of forming eutectics with aluminum are added to form a liquid phase, and the $Al_2O_3$ film is broken by the liquid phase. In the case of rapidly solidifying alloy powder, however, this method cannot be employed since coarse precipitates are formed and segregation is caused.

According to a second embodiment of the invention, instead of the extrusion method, forging is applied. First, aluminum alloy powders produced by the method described above is used. In producing a preform of such strength that no cracks are formed during forging, it is essential that the density be increased to a sufficiently high level and then sintering be applied. The density can be increased satisfactorily by increasing the compacting pressure. In compacting of particles of high hardness, the cold-isostatic pressing method is more effective than the ordinary pressing using a metal die. This high density compacting breaks the oxide coating on the powdered particles, thereby greatly increasing the contact area of the particles. Thus, as the sintering proceeds through solid diffusion during heating, a good sintered body for forging can be obtained.

At the step of forging, residual voids are collapsed, and sintering due to pressure proceeds on the oxide coating-free clean surface.

For the above purpose, hot forging should be employed in place of cold forging. One of the reasons for this is that the sintering is allowed to proceed sufficiently. Another reason is that a deformation resistance is forging is reduced and the deformation into complicated shapes can be attained. If the density after compacting is less than 95%, the voids are connected to the interior and thus air is allowed to pass therethrough. As a result, oxidation readily proceeds. For this reason, it is necessary that the true density ratio be at least 95%.

Heating temperatures lower than 250° C. are not suitable, since at such low temperatures the deformation resistance is large and the sintering due to self diffusion of aluminum does not proceed sufficiently. On the other hand, higher temperatures the fine structure and nonequilibrium phase of the solidified powder by rapid cooling are changed and the features of the rapidly cooled alloy are lost.

EXAMPLE 3

An alloy powder comprising 4% Cu, 1% Mg, 12% Si, 5%=Ex. 2 Fe, the remainder being Al, and having a grain size of −100 mesh which had been obtained by gas atomizing was compacted at a pressure of 6 t/cm$^2$ by the use of a cold-isostatic press. The density of the compact was 2.67 g/cm$^3$, and its actual density ratio was 96.0%. The thusobtained high density compact was heated to 470° C. in the air to conduct die forging. The height of the die was decreased to about ½ by the forging and extended along the die in the direction of diameter. The density of the forged product was 99.8% or more, and no cracking occurred. A test specimen was cut off from this forged body, and tested.

Figure 3:
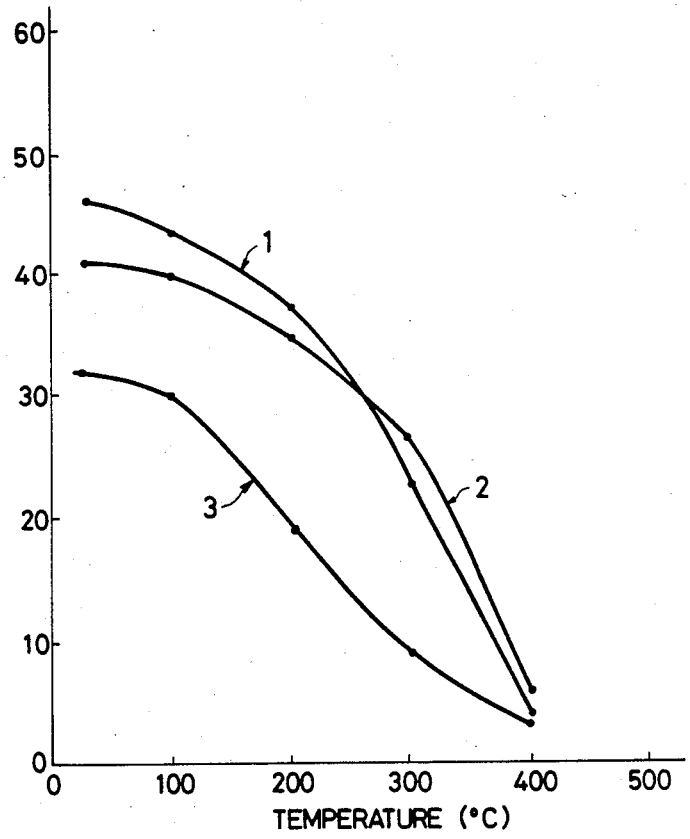
FIG. 3 is a graph showing the variations (1), (2) in tensile strength at high temperatures of the materials of the present invention and the comparative material (3).

FIG. 3 shows the results of measurement of the strength. The Al—Cu—Mg—Si—Fe-base material 1 and the Al—Si—Fe-base material 2 of the present invention were of high strength at high temperatures. With regard to the tensile strength, the material 1 is higher than the material 2 up to about 200° C. but at higher temperatures the material 2 is higher than the material 1. Both the material 1 and 2 are higher in strength than the AC8A-T6 material 3 (cast Al—Si alloy) which has been used as a material for production of a piston.

The wear resistance as determined by the Ogashi wear testing method is shown in Table 5. The materials of the present invention is superior in wear resistance to the comparative AC8A-T6 material.

The results of the measurement of coefficient of thermal expansion are shown in Table 6. The coefficient of thermal expansion of the materials of the present invention are markedly small compared with that of the comparative AC8C-T6 material, and thus they are useful as a heat resistant material.

TABLE 5

| | Specific Wear Amount ($\times 10^{-7}$ mm$^2$/kg) | | |
|---|---|---|---|
| Sliding Speed (m/s) | 0.5 | 2.0 | 3.6 |
| Test Piece | | | |
| Material 1 of the Invention | 1.9 | 1.8 | 5.6 |
| Material 2 of the Invention | 2.8 | 3.8 | 6.2 |
| Comparative material 3 | 3.0 | 12.1 | 9.2 |

TABLE 6

| Test Price | Coefficient of Thermal-Expansion ($\times 10^{-6}$/°C.) |
|---|---|
| Material 1 of the Invention | 16.3 |
| Material 2 of the Invention | 16.7 |
| Comparative Material 3 | 21.6 |

It can be seen from the above results that aluminum alloys which are light weight and have superior characteristics can be produced by the powder forging method and, in turn, mechanical parts of such aluminum alloys can be produced economically.

Turning next, improvement of modulus of elasticity in aluminum alloy will be described with reference to a third embodiment of the present invention.

In the aluminum alloy according to the third embodiment of the present invention, the silicon element is important. The concentration of the silicon element is from 7.0 to 17.0% by weight.

In the phase diagram of an Al—Si-base alloy, the eutectic point exists at 11.7% Si. In the aluminum alloy of the third embodiment, the Si concentration is in the range of the eutectic point ±5%. In the aluminum alloy of this embodiment, the amount of the silicon is 15% or 7%, of the modulus of elasticity tends to drop compared with 12 Si. Thus, in order to obtain a high modulus of elasticity, it is desirable that the concentration of the silicon element approaches to the vicinity of the eutectic temperature.

As the amount of the iron element added is increased, the resulting aluminum alloy tends to have a higher modulus of elasticity. If the amount of the iron element added is in excess of 12% by weight, hot plastic workability (hot forgeability, hot rolling properties, and hot extrudability) is seriously deteriorated. Thus the amount of the iron element added is adjusted to not more than 12% by weight.

Magnesium and copper elements are added to enhance the precipitation of the matrix. The amounts of the magnesium and copper elements added are not more than 2% by weight and not more than 6.5% by weight, respectively.

If the amount of the magnesium element added is large, workability is deteriorated. Thus the amount of the magnesium element added is not more than 2% by weight. Even if the amount of the copper element added is increased, any marked increase in strength cannot be obtained; rather the formation of fine pores is caused. Thus it is preferred that the amount of the copper element added be not more than 6.5% by weight.

The aluminum alloy of the present invention, which contains such large amounts of silicon and iron elements, is difficult to produce by the conventional casting method. The reason for this is that if the silicon and iron elements are added to the aluminum matrix in large amounts, primary crystals resulting from coarse silicon and iron grains are formed, since the degrees of solid solution of silicon and iron in the aluminum are small; this leads to a marked reduction in the strength of the ultimate alloy.

Techniques to produce finely dispersed primary crystals of silicon and iron include a method of adding small amounts of phosphorus, for example. Particularly effective is to increase a rate of solidification at the solidification of a melt. For this purpose, an aluminum alloy melt is powdered by atomizing in the air or atmospheric gas by the use of water or gas, or by a mechanical procedure to produce a powder of −40 mesh, or solidification is allowed to proceed at a rate of solidification of at least $10^2$ K/s (100 K cooling per second). In the case of −40 mesh atomized powder, the rate of solidification is $10^2$ K/s or more. In the case of the alloy solidified at a rate of $10^2$ K/s or more, precipitates of 10 μm or more are not formed and thus a fine uniform structure is obtained. When the thus-produced powder is subjected to hot plastic working (hot extrusion and hot forging), there can be obtained an alloy material having a uniform and fine structure in which the true specific density ratio is almost 100%.

The thus-produced aluminum alloy material is very improved in all the strength, heat resistance, and wear resistance compared with the conventional aluminum alloys.

EXAMPLE 4

A −100 mesh Al—Si—Fe—Cu—Mg-base alloy powder which had been produced by air atomizing was hot extruded to produce a hot extruded material. The characteristics of this material were examined.

In this extrusion, the alloy powder was packed in a can, heated at 470° C. for about 2 hours, and then extruded at an extrusion ratio of about 7:1.

The characteristics of the above-produced Al—Si—Fe—Cu—Mg-base alloy material are shown in Table 7. For comparison, the characteristics of 2014 and 7075 strong aluminum alloy materials produced by the casting method are also shown in Table 7.

The modulus of elasticity was measured by the gauge method and by the supersonic method. The results obtained by these methods were in good agreement with each other.

TABLE 7

| Material | Modulus of Elasticity (kg/mm²) | Tensile Strength (kg/mm²) | Hardness HRB |
|---|---|---|---|
| Al—7Si—5Fe | 7730 | 39 | 61 |
| Al—12Si—3Fe | 9360 | 44 | 65 |
| Al—12Si—5Fe | 9880 | 49 | 69 |
| Al—12Si—7Fe | 10480 | 54 | 75 |
| Al—15Si—2Fe | 7410 | 48 | 76 |
| Al—15Si—4Fe | 7790 | 54 | 85 |
| Al—15Si—5Fe | 8190 | 58 | 92 |
| Al—15Si—8Fe | 8680 | 59 | 93 |
| 2014-T4 | 7500 | 49 | 73 |
| 7075-T6 | 7300 | 58 | 85 |

The Al—Si—Fe-base alloys contained 4.5% by weight of copper and 1% by weight of magnesium.

It can be seen from Table 6 that in the aluminum alloys containing 12% by weight of silicon in the vicinity of the eutectic concentration, the modulus of elasticity is high compared with the aluminum alloys containing 7% by weight and 15% by weight of silicon which are apart from the eutectic concentration.

In addition, the aluminum alloys have high tensile strength and hardness, are good in wear resistance and heat resistance, have a small coefficient of thermal expansion, and are good in plastic workability.

As demonstrated above, an Al—Si—Fe—Cu—Mg-base alloy containing a eutectic concentration of a silicon element is good all the mechanical and thermal properties, and plastic workability.

In view of the above, the alloy of the present invention is widely applicable for producing mechanical parts for air craft, automobile such as engine, piston, cylinder liner and connecting rode, electrical applicance and parts for precise mechanism.

What is claimed is:

1. A method for producing aluminum alloy comprising the steps of:

(a) producing an aluminum alloy powder, said alloy powder consisting of 10 to 36 wt % of Si, 2 to 12 wt % of Fe, 2 to 10 wt % of at least one of metal selected from the group consisting of Ni, Co, Cr and Mn, the reminder consisting of aluminum;

(b) compressing the mass of said powder by compacting said powder, or accumulating said powder in a can, in the case of said compacting, said powder being compacted to have an actual density ratio of 65% to 90%, and in the case of said accumulation, said powder being compressed to have an actual density ratio of not more than 90%;

(c) heating said compressed mass of powder in a convection type heating furnace at a temperature of 250° C. to 550° C. for 5 to 20 hours; and (d) hot extrusion-working said mass of powder at an extrusion ratio of not less than 4 : 1, without cooling the resulting heated compressed mass of powder to produce an aluminum alloy product.

2. The method of claim 1, wherein not more than 6.5 wt % of Cu and not more than 2 wt % of Mg are added in step (a).

3. The method of claim 1, wherein said aluminum alloy powder has precipitate particles having crystal grains being not more than 10 μm in size.

4. The method of claim 1, wherein said aluminum alloy powder is produced by melting component raw materials in a hot crucible and atomizing the melted alloy, with simultaneous cooling, at a cooling rate of not less than $10^2$ K/sec.

5. The method of claim 4, wherein said atomized aluminum alloy powder has a mesh size of −40 mesh.

6. The method of claim 1, wherein said aluminum alloy powder is filled in a metal die in step (b).

7. The method of claim 1, wherein cold-isostatic pressure is applied to said aluminum alloy powder in step (b).

8. The method of claim 1, wherein said aluminum alloy product has a modulus of elasticity not less than 8,000 kg/cm².

9. The method of claim 1, wherein during step (c), said mass of said powder is heated in air by an electric heater.

10. The method of claim 1, wherein during step (c), said mass of said powder is heated in a non-oxidative condition by an electric heater.

11. The method of claim 1, wherein said mass of powder is degassed during step (c).

12. The method of claim 15, wherein said aluminum alloy product consists of 20 wt % of Si, 8 wt % of Ni, Cu, and Mg, and the remainder, Al.

13. The method of claim 1, wherein said aluminum alloy product consists of 20 wt % of Si, 5 wt % of Fe, 2 wt % of Ni, and remainder Al.

14. The method of claim 1, wherein said aluminum alloy product consists of 12 wt % of Si, 5 wt % of Fe, Co, Mg and remainder Al.

15. A method for producing aluminum alloy comprising the steps of:

(a) producing an aluminum alloy powder, said alloy powder consisting of 10 to 36 wt % of Si, 2 to 10 wt % of Ni, 2 to 10 wt % of at least one of metal selected from the group consisting essentially of Fe, Co, Cr and Mn, and the remainder consisting of aluminum;

(b) compressing the mass of said powder by compacting said powder, or accumulating said powder in a can, in the case of said compacting, said powder being compacted to have an actual density ratio of 65% to 90%, and in the case of said accumulation, said powder being compressed to have an actual density ratio of not more than 90%;

(c) heating said compressed mass of powder in a convection type heating furnace at a temperature of 250° C. to 550° C. for 5 to 20 hours;and (d) hot extrusion-working said mass of powder at an extrusion ratio of not less than 4 : 1, without cooling the resulting heated compressed mass of powder to produce an aluminum alloy product.

16. The method of claim 15, wherein not more than 6.5 wt % of Cu and not more than 2 wt % of Mg are added in step (a).

17. The method of claim 15, wherein said aluminum alloy powder has precipitate particles having crystal grains being not more than 10 μm in size.

18. The method of claim 15, wherein said aluminum alloy powder is produced by melting component raw materials in a hot crucible and atomizing the melted alloy, with simultaneous cooling, at a cooling rate of not less than $10^2$ K/sec.

19. The method of claim 18, wherein said atomized aluminum alloy powder has a mesh size of −40 mesh.

20. The method of claim 15, wherein said aluminum alloy powder is filled in a metal die in step (b).

21. The method of claim 15, wherein cold-isostatic pressure is applied to said aluminum alloy powder in step (b).

22. The method of claim 15, wherein said aluminum alloy product has a modulus of elasticity not less than 8,000 kg/cm$^2$.

23. The method of claim 15, wherein during step (c), said mass of said powder is heated in air by an electric heater.

24. The method of claim 15, wherein during step (c), said mass of said powder is heated in a non-oxidative condition by an electric heater.

25. The method of claim 15, wherein said mass of powder is degassed during step (c).

26. The method of claim 15, wherein said aluminum alloy product consists of 20 wt % of Si, 5 wt % of Fe, 2 wt % of Ni, and remainder Al.

27. The method of claim 15, wherein said aluminum alloy product consists of 12 wt % of Si, 5 wt % of Fe, Co, Mg and remainder Al.

* * * * *